US007922257B2

(12) United States Patent
Kammerer

(10) Patent No.: US 7,922,257 B2
(45) **Date of Patent: *Apr. 12, 2011**

(54) CIRCULAR-SHANK TOOL COMPRISING A TOOL HOLDER

(75) Inventor: Karl Kammerer, Fluorn-Winzeln (DE)

(73) Assignee: Betek Bergbau- Und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 331 days.

This patent is subject to a terminal disclaimer.

(21) Appl. No.: 12/083,511

(22) PCT Filed: Jun. 27, 2006

(86) PCT No.: PCT/EP2006/006158

§ 371 (c)(1),
(2), (4) Date: Apr. 11, 2008

(87) PCT Pub. No.: WO2007/048456

PCT Pub. Date: May 3, 2007

(65) Prior Publication Data

US 2009/0160237 A1 Jun. 25, 2009

(30) Foreign Application Priority Data

Oct. 27, 2005 (DE) ..... 10 2005 051 449

(51) Int. Cl.
*E21C 35/197* (2006.01)

(52) U.S. Cl. ..... 299/107

(58) Field of Classification Search ..... 299/102, 299/103, 106, 107; 279/43.5; 37/458
See application file for complete search history.

(56) References Cited

U.S. PATENT DOCUMENTS 3,767,266 A * 10/1973 Krekeler ..... 299/107
4,327,947 A 5/1982 Bower, Jr.
4,684,176 A * 8/1987 Den Besten et al. ..... 299/107
4,850,649 A 7/1989 Beach et al.
4,921,310 A * 5/1990 Hedlund et al. ..... 299/107

(Continued)

FOREIGN PATENT DOCUMENTS

DE 37 12 427 A1 10/1988

(Continued)

OTHER PUBLICATIONS

Co-pending U.S. Appl. No. 12/083,510, filed Apr. 11, 2008; Inventors Karl Kammerer et al.; title Circular-Shank Tool Comprising a Tool Holder.

*Primary Examiner* — John Kreck
(74) *Attorney, Agent, or Firm* — Pauley Petersen & Erickson

(57) ABSTRACT

A circular-shank tool including a tool holder for improving the centering of the shank of the circular-shank tool in the locking sleeve by a configuration of the retaining elements and to improve an ability of the shank to rotate in the sleeve. To achieve this, the retaining elements are distributed between two stamped edges that lie transversely with respect to a longitudinal axis of the locking sleeve and are stamped inwards or indented, the stamped edges extend over part of the circumference of the locking sleeve and are interspaced at a distance that corresponds to the width of the peripheral groove in the shank of the circular-shank tool and the retaining elements form a coaxial concave centering section facing the convex groove base of the peripheral groove.

18 Claims, 2 Drawing Sheets

U.S. PATENT DOCUMENTS

| | | | | |
|---|---|---|---|---|
| 5,503,463 | A * | 4/1996 | Ojanen | 299/107 |
| 6,199,956 | B1 * | 3/2001 | Kammerer | 299/111 |
| 6,786,557 | B2 * | 9/2004 | Montgomery, Jr. | 299/104 |
| 7,380,888 | B2 * | 6/2008 | Ojanen | 299/104 |
| 2002/0153175 | A1 * | 10/2002 | Ojanen | 175/427 |
| 2006/0125308 | A1 * | 6/2006 | Sollami | 299/107 |
| 2007/0152495 | A1 * | 7/2007 | Sollami | 299/107 |

FOREIGN PATENT DOCUMENTS

| | | |
|---|---|---|
| EP | 0 264 015 | 4/1988 |
| EP | 0 295 232 | 12/1988 |
| WO | 03/004832 A1 | 1/2003 |

* cited by examiner

CIRCULAR-SHANK TOOL COMPRISING A TOOL HOLDER

BACKGROUND OF THE INVENTION

1. Field of the Invention

This invention relates to a round shank chisel with a chisel holder, in which a shank of the round shank chisel holder is maintained in the bore of the chisel holder by a slit clamping sleeve, wherein the clamping sleeve is braced against the bore wall of the bore and the shank of the round shank chisel is rotatably maintained in the clamping sleeve, wherein the clamping sleeve has inwardly machined in and/or pressed in holding elements that distributed over a circumference of the clamping sleeve and that engage a circumferential groove cut into the shank of the round shank chisel, so that the clamping sleeve is fixed in place on the shank of the round shank chisel so that it cannot be shifted.

2. Discussion of Related Art

In connection with a round shank chisel with a chisel holder, the axial position of the clamping sleeve on the shank of the round shank chisel is important, so that the front faces of the clamping sleeve are exposed and the clamping sleeve has as little as possible axial play. Also, it is necessary for the shank of the round shank chisel to be centered by the holding devices in the clamping sleeve so that the shank is guided, freely rotatable, in the clamping sleeve braced in the bore of the chisel holder.

A round shank chisel with a chisel holder of the type mentioned at the outset is known from European Patent Reference EP 0 264 015 A1 and German Patent Reference DE 37 12 427 A1. In this round shank chisel with a chisel holder, the holding elements are pushed inward in a point-like or a strip-like manner, so that they have a more or a less large play in the circumferential groove of the shank which, with the clamping sleeve braced in the bore of the chisel holder, also affects the round shank chisel. Also, the holding elements in the circumferential groove of the shank of the round shank chisel do not provide sufficient guide faces for an unequivocal centering of the shank, because of which rotating movement in the clamping sleeve is hampered.

SUMMARY OF THE INVENTION

It is one object of this invention to provide holding elements of the clamping sleeve of a round shank chisel with a chisel holder of the type mentioned above but in such a way that they reduce the axial play, and to improve the centering of the shank in the clamping sleeve so that the shank can rotate without hindrance in the clamping sleeve.

In accordance with this invention, this object is attained with holding elements divided between two punched edges oriented transversely with respect to the longitudinal axis of the clamping sleeve and are punched and/or pressed inward. The punched edges extend over a portion of the circumference of the clamping sleeve and have a distance from each other which corresponds to the width of the circumferential groove in the shank of the round shank chisel. The holding elements, facing the convex groove bottom of the circumferential groove, form a coaxial, concave centering section.

Matching the width of the holding elements to the width of the circumferential groove in the shank of the round shank chisel results in the reduction of axial play between the clamping sleeve and the shank, while the holding elements with coaxial, concave centering sections facing the convex groove bottom optimize the function of the round shank chisel with a chisel holder.

In accordance with one embodiment of this invention, the clamping sleeve has three holding elements, in which one holding element is located opposite the slit in the clamping sleeve, and the other two holding elements are each offset by approximately 100° with respect to the one holding element on the circumference of the clamping sleeve. Thus, the number of holding elements is reduced to a minimum. In connection with the further dimensions of the holding elements, the width of the circumferential groove, and thus the width of the holding elements, is selected to be approximately 1/7 to 1/6 of the axial dimension of the clamping sleeve. The concave centering sections of the holding elements extend over an angular area of approximately 30° to 50° of the circumference of the clamping sleeve. So that the holding elements do not form sharp edges, which could hamper the rotating movement of the shank in the clamping sleeve, in a further embodiment the ends of the concave centering shoulders of the holding elements make a transition via a convex curved portion, a transition section and a concave curved portion into the inner wall of the clamping sleeve. The convex outer sections of the clamping sleeve located opposite the concave centering sections transition at their ends into the outer wall of the clamping sleeve via a concave curved portion.

In a further embodiment, the holding elements are punched and/or pressed inward so far that the convex outer sections which are located opposite the concave centering sections are spaced apart from the inner wall of the clamping sleeve. The depth of the circumferential groove in the shank of the round shank chisel is dimensioned so that with the clamping sleeve braced in the bore of the chisel holder, the concave centering sections of the holding elements rest against the groove bottom of the circumferential groove or take up a short distance from it. Thus, centering of the shank of the round shank chisel is optimized.

The critical point of the clamping sleeve is located on the side of the front face of the clamping sleeve facing the chisel tip. For preventing collisions with this front face, which can lead to an impairment of the rotating movements of the round shank chisel, in one embodiment the front face of the clamping sleeve facing the chisel tip is at a distance from the conical insertion section of the bore in the chisel holder, which receives a conical neck of the chisel head or a centering neck of a wear disk arranged between the chisel holder and the chisel head.

An additionally improved effect on the centering of the shank of the round shank chisel in the clamping sleeve is achieved with a further development if the holding elements are arranged in the center transverse plane of the clamping sleeve, or are arranged symmetrically with respect to the clamping sleeve and the clamping sleeve can be attached to the shank of the round shank chisel in two axial positions rotated by 180° around its longitudinal axis, and is selectively fixed in place in one of the two identical positions. During this, the installation, such as the application of the clamping sleeve to the shank of the round shank chisel in the bore of the chisel holder, is simultaneously made easier. Furthermore, the centering of the clamping sleeve is also thus improved. Also, if two or more rows of holding elements, arranged symmetrically with respect to the center transverse plane, are used, a particularly stable support of the chisel shank results.

The insertion of the round shank chisel into the bore is established if the outer edges at the two front faces of the clamping sleeve are slanted, wherein the slanted outer edges of the front faces of the clamping sleeve extend at an angle of approximately 30° with respect to the outer wall of the clamping sleeve.

BRIEF DESCRIPTION OF THE DRAWINGS

This invention is explained in greater detail in view of an exemplary embodiment represented in the drawings, wherein.

DETAILED DESCRIPTION OF THE INVENTION

Figure 1:
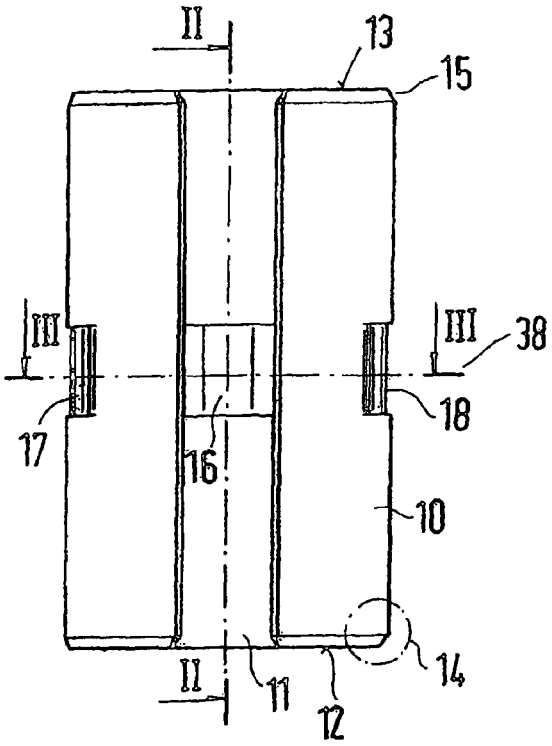
FIG. 1 is a lateral view of the novel clamping sleeve in a view of a slit therein.
Figure 2:
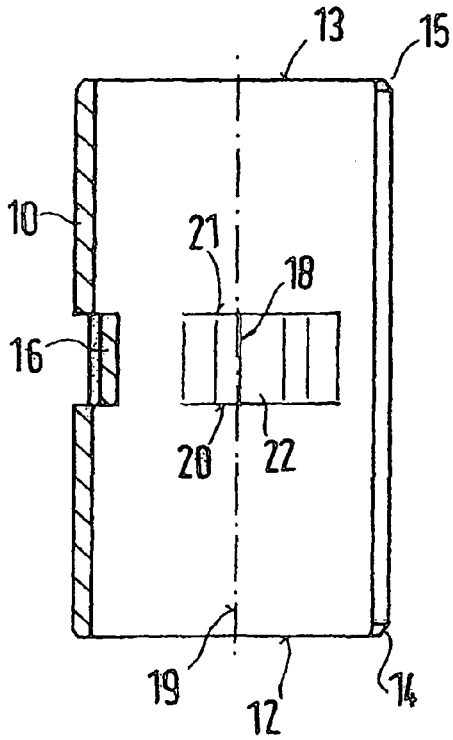
FIG. 2 is a longitudinal sectional view taken through a clamping sleeve, along line II-II as shown in FIG. 1.
Figure 3:
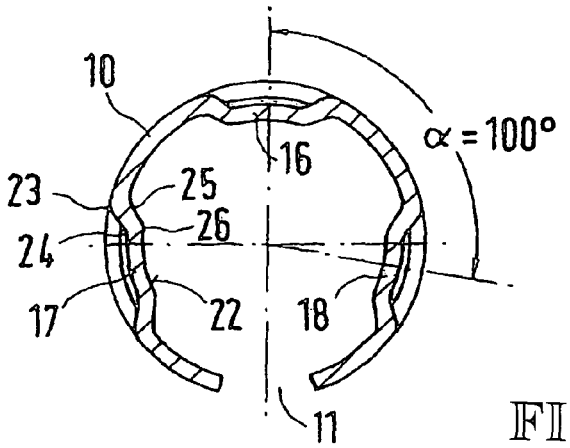
FIG. 3 shows a cross-sectional view taken through the clamping sleeve along the line III-III as shown in FIG. 1.
Figure 4:
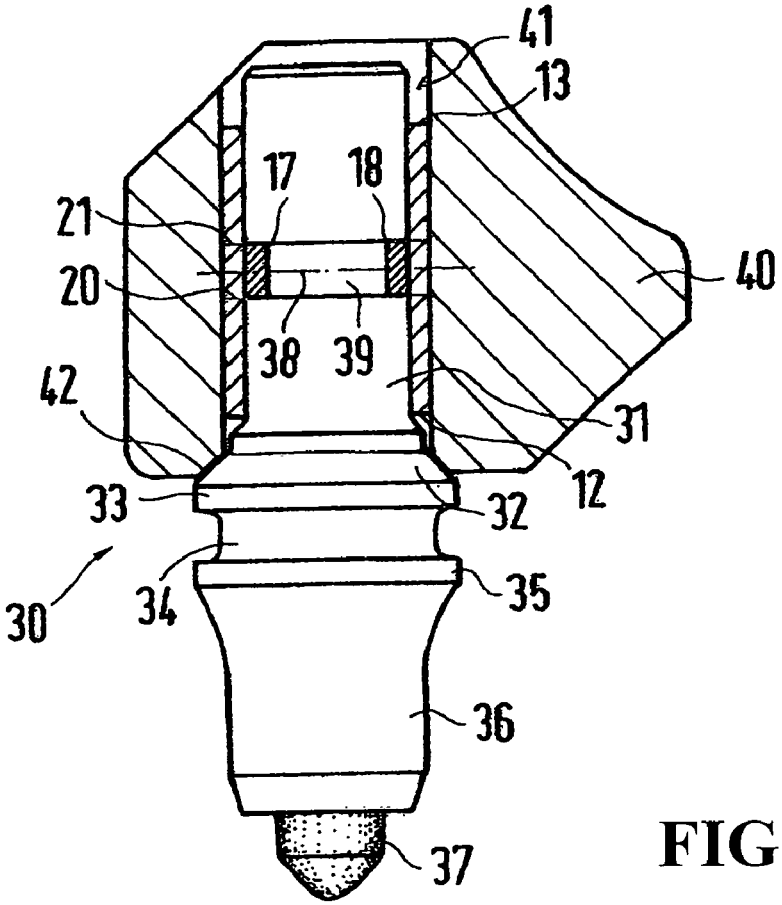
FIG. 4 shows a partial longitudinal section view taken through a round shank chisel with a chisel holder, in which a clamping sleeve in accordance with FIGS. 1 to 3 is applied to the shank and is introduced into the bore of the chisel holder.

As FIGS. 1 to 3 shows, the clamping sleeve 10 has a slit 11 parallel with the longitudinal axis 19, and three holding elements 16, 17, 18 are distributed over the circumference. The holding element 16 is located opposite the slit 11. The two other holding elements 17 and 18 are each offset on the circumference of the clamping sleeve 10 with respect to the holding element 16 by approximately $\alpha$=100°. The holding elements 16, 17, 18 are respectively spaced apart by two parallel punched edges 20 and 21, which are oriented transversely with respect to the longitudinal axis 19 and extend over an angular panel of approximately 30°0 to 50° of the circumference.

In their width, the holding elements 16, 17 and 18 are defined by the distance of the punched edges 20 and 21 and are matched to the width of the circumferential groove 39 in the shank 31 of the round shank chisel 30.

At their ends, the concave centering sections 22 of the holding elements 16, 17 and 18 transition into the inner wall of the clamping sleeve 10 via a convex curved portion 26, a transition section and a concave curved portion 25, while the outer sections of the holding elements 16, 17 and 18, which are located opposite the concave centering sections 22, transition at their ends into the outer wall of the clamping sleeve 10 via a concave curved portion 24, a transition section and a convex curved portion 23. Sharp edges at the inward punched and/or pressed in holding elements 16, 17 and 18 are thus avoided, which can interfere with the free rotation of the shank 31 in the clamping sleeve 10 and the snug bracing of the clamping sleeve 10 in the bore 41 of the chisel holder 40.

As shown in FIG. 3, the holding elements 16, 17 and 18 are punched and/or pressed inward so far that, with the clamping sleeve 10 pre-braced in the bore 41 of the chisel holder 40, their concave centering sections 22 rest against the convex groove bottom of the circumferential groove 39 of the shank 31 or are at a slight distance from it, which again forms an advantage for the free rotatability of the shank 31 in the clamping sleeve 10. A depth of the circumferential groove 39 in the shank 31 of the round shank chisel 30 is of such dimensions that the convex outer sections of the holding elements 16, 17 and 18 are at a slight distance from the inner wall of the clamping sleeve 10, which can also be derived from FIG. 3. The width of the holding elements 16, 17 and 18 is approximately ⅐ to ⅙ of the length of the clamping sleeve 10, as FIG. 2 shows.

In the same way as the known round shank chisels with chisel holders, the holding elements 16, 17 and 18 can be arranged in the end area of or near the clamping sleeve 10 and the shank 31 which faces away from the chisel tip and has the circumferential groove 39, in this case.

For improving the centering of the shank 31 in the clamping sleeve 10, the holding elements 16, 17 and 18 can also be arranged in the area of or near the center transverse plane 38 of the clamping sleeve 10 and can engage the circumferential groove 39 cut into this area of the shank 31. In that case, the clamping sleeve 10 can be attached to the shank 31 in two positions and can be fixed in place thereon in one of two identical positions. This eases the installation of the clamping sleeve 10 because it is not necessary to first bring it into an exactly defined position with respect to the shank 31. Also, the centering of the shank 31 and the free rotatability thereof is improved, because the clamping sleeve 10 can be less canted in its longitudinal direction.

As FIG. 3 shows, the circumferential groove 39 in the shank 31 and the holding elements 16, 17 and 18 are matched to each other so that the front face 12 facing the chisel tip 37 also does not extend into the conical insertion section 42 of the bore 41 in the chisel holder 40, but lies free. The chisel head 36 extends into the conical insertion section 42 with a conical shoulder 32 of the collar 33, which is followed by the pull-off groove 34 and the pull-off collar 35 of the chisel head 36. The chisel tip 37 made of hard metal is inserted into the chisel head 36.

It is also possible to arrange a wear disk between the chisel head 36 and the chisel holder 40, which projects with a centering shoulder into the conical insertion section 42 of the chisel holder 40, and thus does not contact with the facing front face 12 of the clamping sleeve 10.

The invention claimed is:

1. A round shank chisel (30) with a clamping sleeve (10), the round shank chisel (30) is rotatably maintained in the clamping sleeve (10), the clamping sleeve (10) has inwardly punched and/or pressed in holding elements (16, 17, 18) distributed over a circumference of the clamping sleeve (10) and engage a circumferential groove (39) cut into a shank (31) of the round shank chisel (30), the clamping sleeve (10) is fixed in place in an axial direction on the shank (31) of the round shank chisel (30), the clamping sleeve comprising:

the holding elements (16, 17, 18) divided between two punched edges (20, 21) oriented transversely with respect to a longitudinal axis (19) of the clamping sleeve (10) and are punched and/or pressed inward, and the punched edges (20, 21) extending over a portion of the circumference of the clamping sleeve (10) and having a distance from each other which corresponds to a width of a circumferential groove (39) in the shank (31) of the round shank chisel (30).

2. The round shank chisel in accordance with claim 1, wherein the clamping sleeve (10) has three holding elements (16, 17, 18) in which one of the holding elements (16) is located opposite a slit (11) in the clamping sleeve (10), and the other two holding elements (17, 18) each offset with respect to the one holding element (16) by approximately 100° on a circumference of the clamping sleeve (10).

3. The round shank chisel in accordance with claim 2, wherein the width of the circumferential groove (39) and a second width of the holding elements (16, 17, 18) is selected to be approximately ⅐ to ⅙ of an axial dimension of the clamping sleeve (10).

4. The round shank chisel in accordance with claim 3, wherein concave centering sections (22) of the holding elements (16, 17, 18) extend over an angular area of approximately 30° to 50° of a circumference of the clamping sleeve (10).

5. The round shank chisel in accordance with claim 4, wherein ends of the concave centering sections (22) of the holding elements (16, 17, 18) transition via a convex curved portion (26), a transition section and a concave curved portion (25) into an inner wall of the clamping sleeve (10), and convex outer sections of the clamping sleeve (10) located opposite the concave centering sections (22) transition at ends into the outer wall of the clamping sleeve (10) via a concave curved portion (23).

6. The round shank chisel in accordance with claim 5, wherein the holding elements (16, 17, 18) are punched and/or pressed inward so far that the convex outer sections located opposite the concave centering sections (22) are spaced apart from the inner wall of the clamping sleeve (10), and a depth of the circumferential groove (39) in the shank (31) of the round shank chisel (30) is sized so that with the clamping sleeve (10) braced in a bore (41) of a chisel holder (40), the concave centering sections (22) of the holding elements (16, 17, 18) rest against or are a short distance from the groove bottom of the circumferential groove (30).

7. The round shank chisel in accordance with claim 6, wherein a front face of the clamping sleeve (10) facing a chisel tip (37) is at a distance from a conical insertion section (42) of a bore (41) in the chisel holder (40), which receives a conical neck (32) of a chisel head (36) or a centering neck of a wear disk arranged between the chisel holder (40) and the chisel head (36).

8. The round shank chisel in accordance with claim 7, wherein the holding elements (16, 17, 18) are arranged in a center transverse plane (38) of the clamping sleeve (10) or are arranged symmetrically with respect to the center transverse plane (38), and the clamping sleeve (10) is attachable to the shank (31) of the round shank chisel (30) in two axial positions rotated by 180° around the longitudinal axis, and is selectively fixed in place in one of the two axial positions.

9. The round shank chisel in accordance with claim 8, wherein outer edges (14, 15) at two front faces (12, 13) of the clamping sleeve (10) are slanted.

10. The round shank chisel in accordance with claim 9, wherein the slanted outer edges (14, 15) of the clamping sleeve (10) extend at an angle of approximately 30° with respect to an outer wall of the clamping sleeve (10).

11. The round shank chisel in accordance with claim 1, wherein the width of the circumferential groove (39) and a second width of the holding elements (16, 17, 18) is selected to be approximately 1/7 to 1/6 of an axial dimension of the clamping sleeve (10).

12. The round shank chisel in accordance with claim 1, wherein concave centering sections (22) of the holding elements (16, 17, 18) extend over an angular area of approximately 30° to 50° of a circumference of the clamping sleeve (10).

13. The round shank chisel in accordance with claim 1, wherein ends of concave centering sections (22) of the holding elements (16, 17, 18) transition via a convex curved portion (26), a transition section and a concave curved portion (25) into an inner wall of the clamping sleeve (10), and convex outer sections of the clamping sleeve (10) located opposite the concave centering sections (22) transition at ends into an outer wall of the clamping sleeve (10) via a concave curved portion (23).

14. The round shank chisel in accordance with claim 1, wherein the holding elements (16, 17, 18) are punched and/or pressed inward so far that convex outer sections located opposite concave centering sections (22) are spaced apart from an inner wall of the clamping sleeve (10), and a depth of the circumferential groove (39) in the shank (31) of the round shank chisel (30) is sized so that with the clamping sleeve (10) braced in a bore (41) of a chisel holder (40), the concave centering sections (22) of the holding elements (16, 17, 18) rest against or are a short distance from the groove bottom of the circumferential groove (39).

15. The round shank chisel in accordance with claim 1, wherein a front face (11) of the clamping sleeve (10) facing the chisel (37) tip is at a distance from a conical insertion section (42) of a bore (41) in a chisel holder (40), which receives a conical neck (32) of a chisel head (36) or a centering neck of a wear disk arranged between the chisel holder (40) and the chisel head (36).

16. The round shank chisel in accordance with claim 1, wherein the holding elements (16, 17, 18) are arranged in a center transverse plane (38) of the clamping sleeve (10) or are arranged symmetrically with respect to a center transverse plane (38), and the clamping sleeve (10) is attachable to the shank (31) of the round shank chisel (30) in two axial positions rotated by 180° around the longitudinal axis, and is selectively fixed in place in one of two identical positions.

17. The round shank chisel in accordance with claim 16, wherein outer edges (14, 15) at two front faces (12, 13) of the clamping sleeve (10) are slanted.

18. The round shank chisel in accordance with claim 1, wherein slanted outer edges (14, 15) of the clamping sleeve (10) extend at an angle of approximately 30° with respect to outer wall of the clamping sleeve (10).

* * * * *